US010520282B2

(12) United States Patent
Nangunoori

(10) Patent No.: US 10,520,282 B2
(45) Date of Patent: Dec. 31, 2019

(54) MULTIFUNCTIONAL PERSONAL SAFETY DEVICE

(71) Applicant: Ramesh Gupta Nangunoori, Winter Springs, FL (US)

(72) Inventor: Ramesh Gupta Nangunoori, Winter Springs, FL (US)

( * ) Notice: Subject to any disclaimer, the term of this patent is extended or adjusted under 35 U.S.C. 154(b) by 0 days.

(21) Appl. No.: 16/374,555

(22) Filed: Apr. 3, 2019

(65) Prior Publication Data

US 2019/0271528 A1 Sep. 5, 2019

Related U.S. Application Data

(63) Continuation of application No. 16/289,146, filed on Feb. 28, 2019.

(60) Provisional application No. 62/637,144, filed on Mar. 1, 2018.

(51) Int. Cl.
*F41H 9/10* (2006.01)
*G08B 15/00* (2006.01)

(52) U.S. Cl.
CPC ..... *F41H 9/10* (2013.01); *G08B 15/004* (2013.01)

(58) Field of Classification Search
CPC .... F41H 9/10; F41H 13/0012; F41H 13/0018; G08B 15/004; G08B 15/005; G08B 15/008; G08B 15/007; G08B 15/001
USPC ..... 42/1.08
See application file for complete search history.

(56) References Cited

U.S. PATENT DOCUMENTS 5,476,192 A * 12/1995 Julinot ..... B65D 83/384 116/81
5,549,220 A * 8/1996 Whalen ..... B05B 9/0805 116/81
5,904,414 A * 5/1999 Monteleone ..... F21L 4/005 362/202
5,941,629 A * 8/1999 Tuscher ..... F41H 9/10 222/113
5,952,916 A * 9/1999 Yamabe ..... B25D 1/00 340/321
6,052,051 A * 4/2000 Whalen ..... F41H 9/10 222/1
6,394,622 B1 * 5/2002 Macek ..... F21L 4/025 362/184
6,666,566 B1 * 12/2003 Uke ..... F21V 33/0064 362/109
7,051,391 B2 * 5/2006 Wang ..... B25F 1/00 7/144
7,100,602 B2 * 9/2006 Cole ..... B05B 15/00 128/200.11

(Continued)

*Primary Examiner* — Joshua E Freeman
(74) *Attorney, Agent, or Firm* — Jason T. Daniel, Esq.; Daniel Law Offices, P.A.

(57) ABSTRACT

A multifunctional personal safety device includes a main body having an ergonomic gripping surface, and a finger trigger for selectively activating a non-contact deterrent unit and an active deterrent unit. The non-contact deterrent unit including a controller, memory, wireless communication unit, a siren, a light, a laser, and a camera. The information captured by the camera is stored in one or both of a removable media card and the onboard memory. The active deterrent unit includes an aerosol canister containing one or both of a chemical irritant or an inflammatory agent. A safety switch transitions between a locked and unlocked position wherein the finger trigger is selectively blocked and allowed to engage the aerosol canister, respectively.

12 Claims, 4 Drawing Sheets

(56) References Cited

U.S. PATENT DOCUMENTS 7,152,990 B2 * 12/2006 Kukuk ..... F21V 33/0064 362/112
D585,520 S * 1/2009 Teig ..... D22/117
7,524,076 B2 * 4/2009 Kukuk ..... F41C 23/10 362/109
7,937,871 B2 * 5/2011 Mantas ..... F41A 9/65 225/103
D681,768 S * 5/2013 Ross, Jr. ..... D22/117
D688,769 S * 8/2013 Lord ..... D22/117
8,556,125 B2 * 10/2013 Dapper ..... F41H 9/10 222/113
8,985,397 B2 * 3/2015 Lord ..... G08B 21/02 222/1
8,988,229 B2 * 3/2015 Lord ..... G08B 21/02 222/23
10,054,305 B1 * 8/2018 Slepack ..... F21V 33/0064
10,215,397 B2 * 2/2019 Nawaz ..... F21V 33/0064
2002/0108966 A1 * 8/2002 Park ..... F41H 9/10 222/113
2004/0184260 A1 * 9/2004 Kukuk ..... F21V 33/0064 362/96
2004/0188471 A1 * 9/2004 Cellini ..... F41B 15/02 222/192
2005/0092320 A1 * 5/2005 Cole ..... B05B 15/00 128/200.14
2006/0086032 A1 * 4/2006 Valencic ..... F41H 13/0018 42/70.01
2007/0086190 A1 * 4/2007 Kukuk ..... F41C 23/10 362/253
2007/0194048 A1 * 8/2007 Teig ..... F21V 33/0076 222/113
2012/0279105 A1 * 11/2012 Emde ..... F41A 11/04 42/1.08
2014/0252027 A1 * 9/2014 Lord ..... F41H 9/10 222/79
2014/0252028 A1 * 9/2014 Lord ..... F41H 9/10 222/79
2016/0012701 A1 * 1/2016 Lu ..... F41H 9/10 222/183
2016/0040965 A1 * 2/2016 Chang ..... F41H 13/0025 42/1.08
2019/0109932 A1 * 4/2019 Higgins ..... H04M 1/21

* cited by examiner

MULTIFUNCTIONAL PERSONAL SAFETY DEVICE

CROSS-REFERENCE TO RELATED APPLICATIONS

This application claims the benefit of U.S. application Ser. No. 62/637,144 filed on Mar. 1, 2018 and U.S. application Ser. No. 16/289,146 filed on Feb. 28, 2019, the contents of which are incorporated herein by reference.

TECHNICAL FIELD

The present invention relates generally to safety products, and more particularly to a multifunctional personal safety device.

BACKGROUND

The statements in this section merely provide background information related to the present disclosure and may not constitute prior art.

Owing to the increasing number of unprovoked violent attacks, more and more people are investing in personal safety products. As many individuals are not comfortable carrying lethal weapons such as knives or guns, the majority of consumer-oriented safety products are nonlethal in nature. Several of the most popular products include non-contact audiovisual types of devices such as flashlights and whistles, for example. Such devices are intended to draw attention to the situation so as to solicit help from anyone nearby. Conversely, other products are directed toward active protection devices such as a stun gun, pepper spray, or taser, for example. Such devices are intended to be used as a last line of defense to a victim under attack.

Depending on the situation in which a user finds themselves, they may need to quickly transition from non-contact to active protection and may not have the time or ability to switch between multiple different devices. Additionally, after the encounter has concluded, the victim may need to provide evidence to the police showing the actions of the assailant that required the victim to deploy the non-contact and/or active protection.

Accordingly, it would be beneficial to provide a single multifunctional personal safety device which provide a user with both passive and active protection options and that can provide a user with video evidence of the entire encounter so as to overcome the drawbacks described above.

SUMMARY OF THE INVENTION

The present invention is directed to a multifunctional personal safety device. One embodiment of the present invention can include a main body having an ergonomic gripping surface, and a finger trigger for selectively activating a non-contact deterrent unit and an active deterrent unit.

In one embodiment, the non-contact deterrent unit can include one or more audiovisual components such as a siren, a light, a laser, and a camera. The information captured by the camera can be stored in a removable media card and/or on the onboard memory. A charging port can be provided to charge the device battery and transfer information to and from the onboard memory.

In one embodiment, the active deterrent unit can include an aerosol canister containing a chemical irritant and/or inflammatory agent such as pepper spray, for example. The main body can also include a safety switch that can transition between a locked and unlocked position wherein the finger trigger is selectively blocked and allowed to engage the aerosol canister, respectively.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1B:
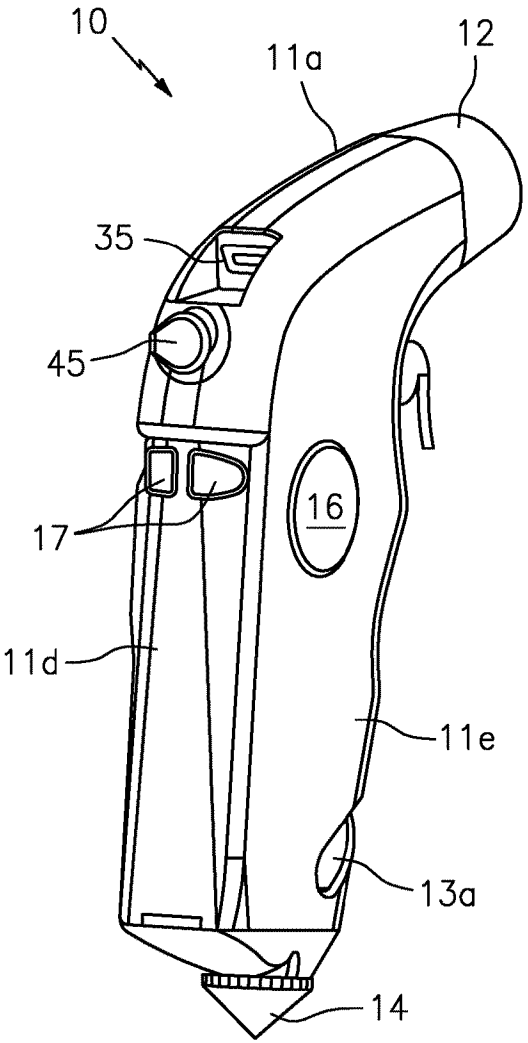
FIG. 1B is another perspective view of a multifunctional personal safety device in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material (i.e. Velcro®), magnets, and/or compression fittings such as locking pins, clamps, nut/bolts, tethers (e.g., zip ties), snaps and buttons, for example.

Moreover, the term "permanently secured" shall be used to describe a situation wherein two or more objects are joined together in a manner so as to prevent the same objects from being separated. Several nonlimiting examples include various adhesives such as glue or resin, hardware such as nuts and bolts, and welds, for example.

FIGS. 1A-4B illustrate one embodiment of a multifunctional personal safety device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 1A:
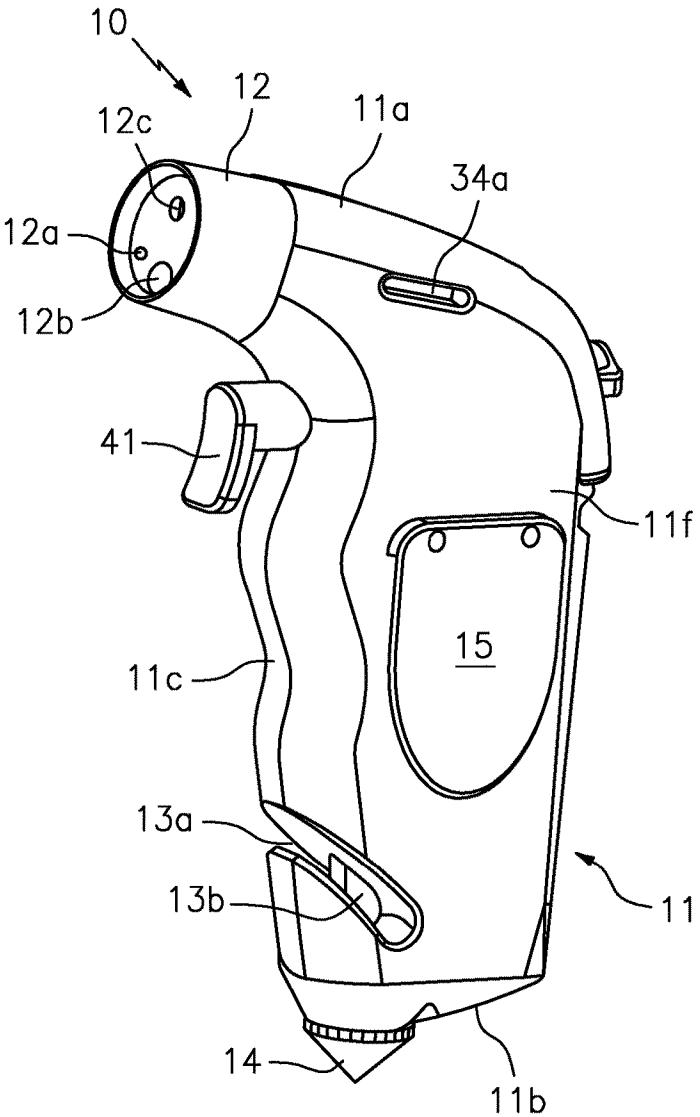
FIG. 1A is a perspective view of a multifunctional personal safety device in accordance with one embodiment of the invention.

As shown in FIGS. 1A and 1B, the assembled device 10 can include a main body 11 having a top end 11*a*, a bottom end 11*b*, a front end 11*c*, a rear end 11*d* and a pair of sides 11*e* and 11*f* that define a generally hollow interior space. In the preferred embodiment, the main body can include the illustrated ergonomic grip and can include texturing along the outside surface to increase the ability of a user to grip the device at all times.

Of course, the main body is not limited to such a shape, as the main body 11 can include any number of different shapes and sizes and can be constructed from any number of different materials suitable for encompassing each of the below described device elements. In the preferred embodiment, the main body 11 can be constructed from lightweight injection molded plastic and can include a plurality of internal tabs/guides/connectors (e.g., 11*g*) for securely housing and positioning each of the device elements.

Additionally, the main body is not limited to the use of plastic, as any number of lightweight materials that are, for example, relatively strong and stiff for their weight may also be utilized. Several nonlimiting examples include but are not limited to various metals or metal alloys (e.g., aluminum, steel, titanium, or alloys thereof) and/or various composite materials (e.g., carbon fibers in a polymer matrix, fiberglass, etc.), for example.

In one embodiment, a cap 12 can be positioned along the front end of the main body. The cap can include three apertures 12*a*, 12*b* and 12*c*, each having a shape, size and location that corresponds to the outputs of the below described tube 22*a*, light 32 and camera 33, respectively. Such a feature is important as this ensures the camera is always oriented toward the direction the protection devices (e.g., light, camera and spray) are being discharged.

In one embodiment, an emergency seatbelt cutter having an elongated channel 13*a* and blade 13*b* can be positioned along the main body. The seatbelt cutter being useful in an emergency situation wherein an occupant is trapped in a vehicle and cannot release the seatbelt.

In one embodiment, an emergency window punch breaker 14 can be provided along the main body 11. The punch breaker can preferably be constructed from hardened metal and can include a conical shape, as are known in the art. The punch breaker functioning to allow a user trapped within a vehicle to easily break the vehicle glass window to escape during an emergency situation.

In one embodiment, the main body can also include a clip 15, such as a belt clip or other similar device capable of allowing the main body to be carried on or secured to an article of clothing. Additionally, as many purses and handbags are now being produced with an internal magnet for engaging keychains and other such items, one embodiment of the device 10 can include a metallic plate 16 so as to allow the device to be secured to the internal magnet of such handbags, thereby allowing a user to easily locate and retrieve the device in an emergency situation. Further, the main body can include a channel 17 through which a retention member such as a lanyard (not illustrated) or other such component may be secured.

Figure 2:
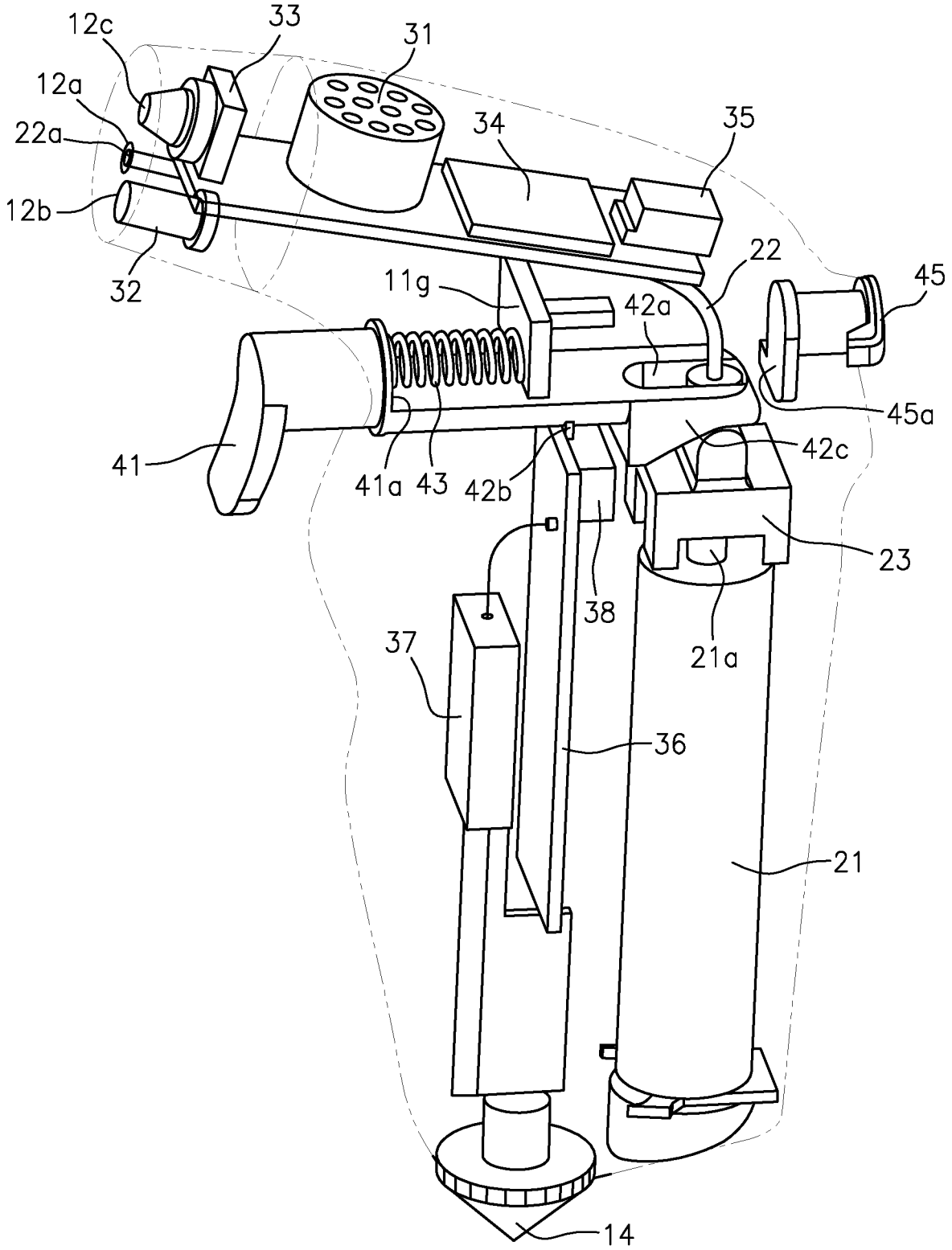
FIG. 2 is a side view of one embodiment of the multifunctional personal safety device wherein a portion of the main body is removed for ease of illustration.

FIG. 2 illustrates one embodiment of the device 10 wherein half of the main body 11 is removed for ease of illustration. As shown, the device 10 can include both a non-contact deterrent unit, and an active deterrent unit that are activated by a trigger assembly. As described herein, a "unit" means a series of identified physical components which are linked together and/or function together to perform a specified function.

The active deterrent unit can preferably include an aerosol canister 21 containing a chemical irritant and/or inflammatory agent such as pepper spray, for example, that is connected to a discharge tube 22 via a plunger 23. The canister can be removably secured within the main body via a removable panel so as to be replaced when depleted. As shown, the second end of the discharge tube 22*a* can be aligned with the aperture 12*a*, so as to discharge the canister contents from the cap 12.

The non-contact deterrent unit can include any number of different components that are capable of providing an audible and/or visual deterrent when activated by the trigger assembly 41. In various embodiments, the non-contact deterrent unit can include, comprise or consist of a siren 31, a light 32, a camera 33, a removable memory 34, a charging port 35, a controller 36, a battery 37 and/or a contact switch 38.

As described herein, the siren 31 can include any number of speakers capable of playing a high frequency alarm sound upon activation.

In the preferred embodiment, the light 32 can include one or more light emitting diodes (LED) and/or a laser, such as a diode laser, for example that produces at least 1,100 lumens. Such a brightness being sufficient to temporarily blind or disorient an average human adult. The light can be activated to produce a sustained beam of light, and/or to produce a strobing effect. Of course, any number of other types of light producing devices and/or brightness levels are also contemplated for use herein. As shown, the output of the light 32 can be aligned with the aperture 12*b*, so as to shine through the cap 12.

The camera 33 can include any type of miniature image capture device that is capable of recording still or moving images in any one of the visible, near-infrared, or any appropriate spectrum, and may utilize a CCD (charge-coupled device) or CMOS (complementary metal-oxide semiconductor) imaging sensors, for example. In the preferred embodiment, the camera will include an integrated microphone for capturing audio content.

In either instance, the image capture device can incorporate any number of known focusing lenses including a short or wide field-of-view lens to capture images that are proximately located near the device. As shown, the lens of the camera 33 can be aligned with the aperture 12*c*, so as to capture images through the cap 12. These images can be stored within the removable memory 34 and/or the onboard memory 36*b* of the system controller 36.

In the preferred embodiment, the removable memory 34 can include a media card such as an SD or micro SD memory card and reader having a card slot 34*a* that is positioned along the main body 11. Of course, the device is not limited to the use of such components, as any number of other devices capable of being removably secured to the device and storing camera information are also contemplated.

The device can also include a charging and information port 35 such as the illustrated micro USB port, for example. The port can be communicatively linked to the system controller 36 for sending and receiving information. The port can also function to recharge the onboard battery 37 which is preferably a rechargeable lithium ion battery.

Figure 3:
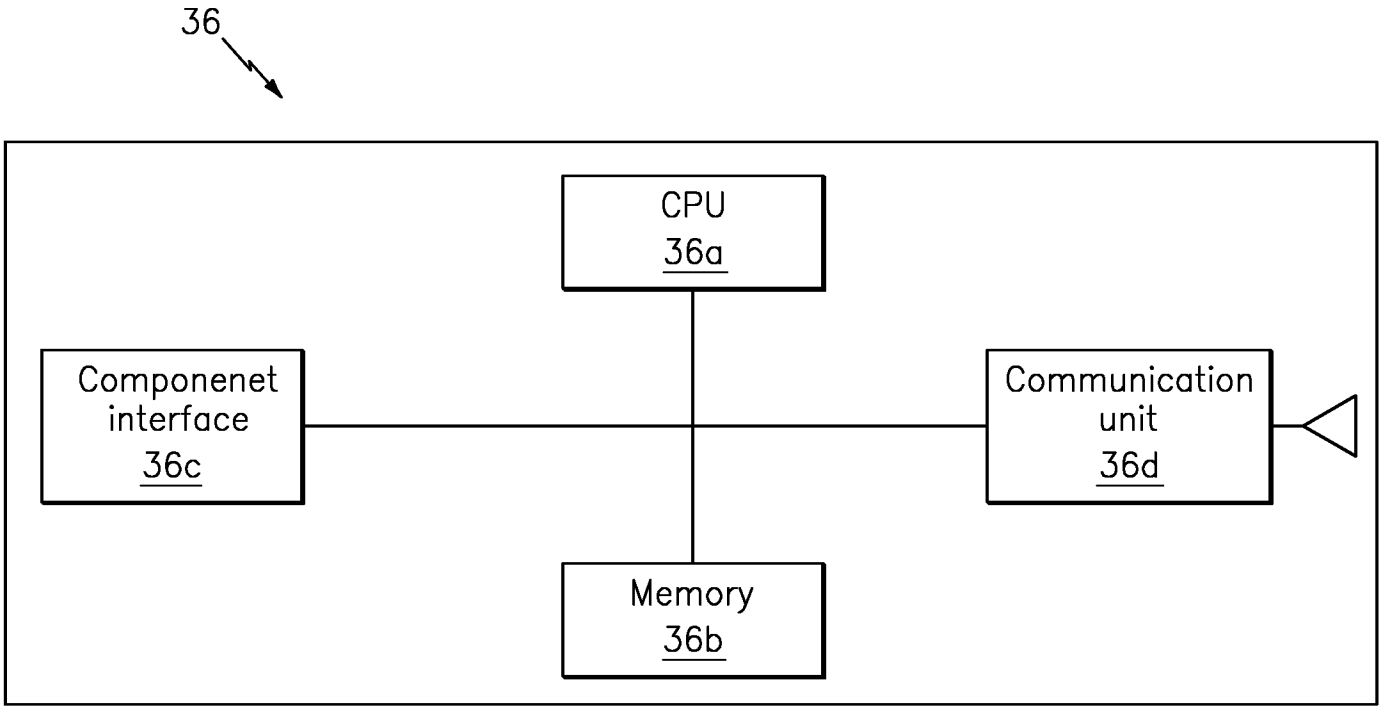
FIG. 3 is a simplified block diagram of the controller of the multifunctional personal safety device, in accordance with one embodiment of the invention.

As shown in cutout FIG. 3, the system controller 36 can include a processor 36*a* that is conventionally connected to an internal memory 36*b*, a component interface unit 36*c*, and a communication unit 36*d*.

Although described or illustrated as separate elements, those of skill in the art will recognize that one or more of the non-contact system components may comprise, include or consist of one or more printed circuit boards (PCB) containing any number of integrated circuit or circuits for completing the activities described herein. This may include one or more integrated circuits having firmware for causing the circuitry to complete the activities described herein. Of course, any number of other analog and/or digital components capable of performing the described functionality can be provided in place of, or in conjunction with the described system elements.

The processor 36*a* can be a conventional central processing unit (CPU) or any other type of device, or multiple devices, capable of manipulating or processing information such as program code stored in the memory 36*b* in order to allow the device to perform the functionality described herein. In either instance, processors and timers are extremely well known in the art, therefore no further description will be provided.

Memory 36*b* can act to store operating instructions in the form of program code for the processor 36*a* to execute. Although illustrated in FIG. 3 as a single component, memory 36*b* can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example, containing programs that permit the processor to perform the functionality described below, along with storage of information captured by the camera 33. Each of these devices are well known in the art.

The internal component interface unit 36*c* can function to provide a communicative link between the processor 36*a* and various other device components such as the siren 31, light 32, camera 33, removable memory 34, information/charging port 35 and contact switch 38. In this regard, the component interface unit can include any number of different components such as one or more PIC microcontrollers, internal bus, and other such hardware capable of providing a direct link between the various components. Of course, any other means for providing the two-way communication between the identified components can also be utilized herein.

The communication unit 36*d* can include any number of components capable of sending and/or receiving electronic signals with an externally located device, either directly via the information port 35 or wirelessly. In one preferred embodiment, the communication unit can include a Bluetooth transceiver for communicating wirelessly with an external device such as a smartphone, running an App. In this regard, the App can be provided as a part of the system and can function to automatically dial 911 whenever the non-contact actuation unit is engaged, for example. Of course, any number of other known transmission and reception mechanisms and protocols can also be utilized herein, several nonlimiting examples include Near-Field-Communication (NFC) devices, radio transceivers, cellular transceivers and the like.

The controller can also include functionality for monitoring a charge level of the battery and selectively activating the speaker to notify a user when the battery level reaches a level at which recharging is recommended.

The trigger assembly can function to selectively activate one or both of the non-contact deterrent unit, and the active deterrent unit. As shown, the assembly can include a finger trigger 41, that is connected to an elongated shaft 42 having an opening 42*a* along a distal end and a pair of protrusions 42*b* and 42*c* extending downward from the shaft. A spring 43 is positioned between an inside wall 41*a* of the finger trigger and an internal tab 11*g*, and a thumb activated safety switch 45 selectively blocks access to the active deterrent unit.

Figure 4B:
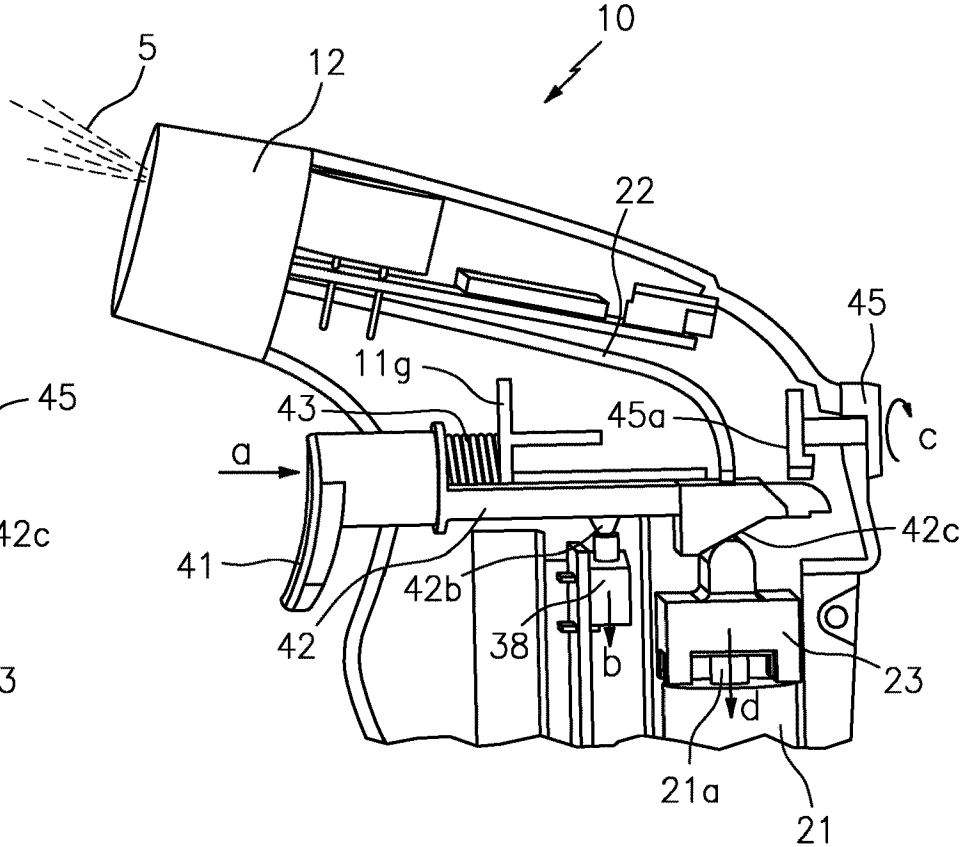
FIG. 4B is another partial cutout view of the trigger assembly of the multifunctional personal safety device, in accordance with one embodiment of the invention.
Figure 4A:
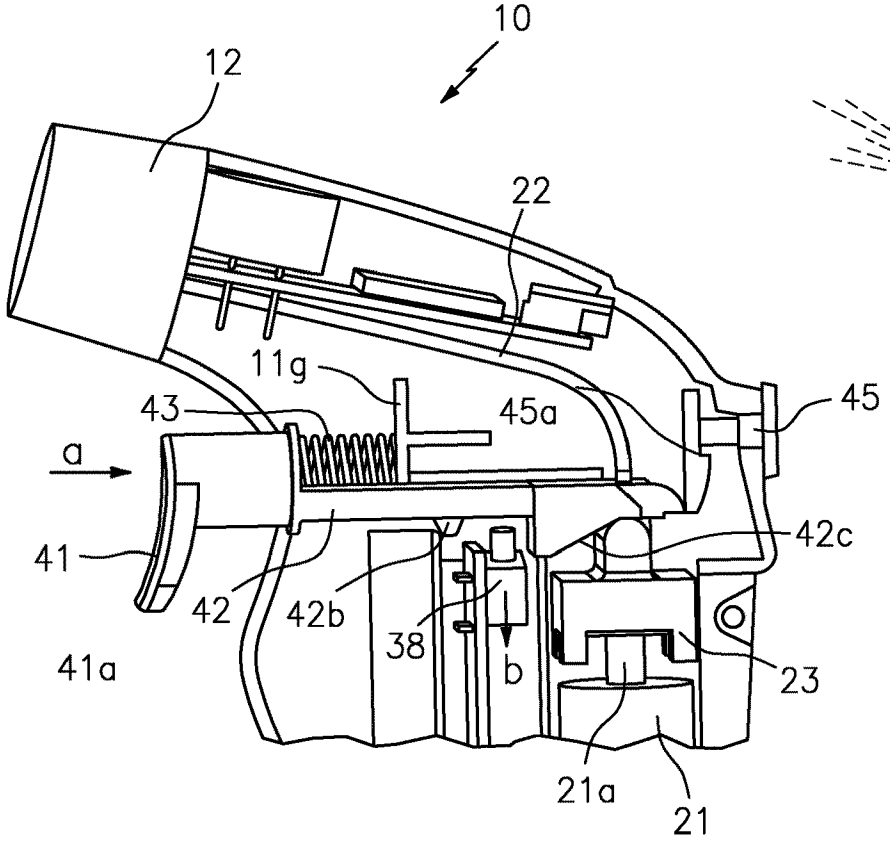
FIG. 4A is a partial cutout view of the trigger assembly of the multifunctional personal safety device, in accordance with one embodiment of the invention.

FIGS. 4A and 4B illustrate one embodiment of the trigger assembly in operation to selectively engage the non-contact deterrent unit and the physical deterrent unit, respectively, based on the orientation of the safety switch 45. In each of these figures several device components are omitted for ease of illustration.

As shown in FIG. 4A, a user can depress the finger trigger 41 (arrow a), to cause the shaft 42 to move against the tension of the spring 43. This movement causes the first protrusion 42*b* to engage the contact switch 38 (arrow b), thereby causing the controller 36 to activate one or all of the audiovisual components such as the siren 31, light 32 and camera 33. In the illustrated example, the safety switch 45 is in the locked position which results in the L-shaped internal tab 45*a* being rotated to prevent further movement of the shaft 42.

As shown in FIG. 4B, when the safety switch 45 is rotated to the unlocked position (arrow c), the L-shaped internal tab 45*a* is rotated away and does not block the continued movement of the shaft 42. As such, when the user continues to press the trigger 41, the angled surface of the second protrusion 42*b* pushes (see arrow d) the plunger 23 toward the canister 21. This movement depresses the neck 21*a* of the canister causing the pepper spray 5 or other such contents to be released through the discharge tube 22 and out of the cone 12.

In this regard, it is noted that operation of the camera 33 and other audiovisual components continues when the canister is discharged, thus providing a visual record of the entire incident. As noted above, this captured information can be stored in the removable memory 34 and/or the internal memory 36*b* and can be transmitted wirelessly to an external device by the wireless communication unit 36*d*.

Accordingly, the above described multifunctional personal protection device provides a user with a plurality of non-contact deterrents and active protection in a single device, while simultaneously capturing an audiovisual record of the incident for use by law enforcement officials.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A personal safety device, comprising:

a main body having an outside surface and an interior space;

a single switch consisting of a finger-operated trigger switch that is positioned along the main body;

a non-contact deterrent unit that is positioned within the interior space of the main body, said non-contact deterrent unit including a controller having a memory and at least one audiovisual component that is selectively actuated by the finger trigger;

an active deterrent unit that is positioned within the interior space of the main body, said active deterrent unit including an aerosol canister that is selectively activated by the finger trigger; and a safety switch that is positioned along the main body, said safety switch being configured to transition between a locked position and an unlocked position, wherein in the locked position, the safety switch allows the finger operated trigger to operate the non-contact deterrent unit and prevents operation of the active deterrent unit.

2. The device of claim 1, wherein the at least one audiovisual component includes a camera that is configured to capture video images for storage by the memory.

3. The device of claim 2, wherein the camera further includes a microphone that is configured to capture audio information for storage by the memory.

4. The device of claim 3, wherein the memory includes a removable media card and card reader.

5. The device of claim 1, wherein the at least one audiovisual component includes a siren that is configured to sound an audible alarm.

6. The device of claim 1, wherein the at least one audiovisual component includes a light emitting diode that is configured to produce a strobing effect.

7. The device of claim 1, wherein the at least one audiovisual component includes a diode laser that is configured to produce a continuous beam of concentrated light.

8. The device of claim 1, wherein in the unlocked position the safety switch allows operation of both the non-contact deterrent unit and the active deterrent unit.

9. The device of claim 1, wherein the aerosol canister includes at least one of a chemical irritant or an inflammatory agent.

10. The device of claim 1, wherein the aerosol canister is removably positioned within the main body.

11. The device of claim 1, further comprising:

a seatbelt cutter.

12. The device of claim 1, further comprising:

a punch glass breaker.

* * * * *